US010352101B2

(12) United States Patent
Yang

(10) Patent No.: US 10,352,101 B2
(45) Date of Patent: Jul. 16, 2019

(54) COMPOSITE DRILL BIT

(71) Applicant: Liyuan Yang, Beijing (CN)

(72) Inventor: Liyuan Yang, Beijing (CN)

(73) Assignee: Chengdu Weiyi Petroleum Technology Co., Ltd., Chengdu, Sichuan (CN)

( * ) Notice: Subject to any disclaimer, the term of this patent is extended or adjusted under 35 U.S.C. 154(b) by 526 days.

(21) Appl. No.: 14/766,509

(22) PCT Filed: Feb. 6, 2014

(86) PCT No.: PCT/CN2014/071866
§ 371 (c)(1),
(2) Date: Sep. 9, 2015

(87) PCT Pub. No.: WO2014/121748
PCT Pub. Date: Aug. 14, 2014

(65) Prior Publication Data

US 2015/0368977 A1 Dec. 24, 2015

(30) Foreign Application Priority Data

Feb. 7, 2013 (CN) ..... 2013 1 0047803

(51) Int. Cl.

| | |
|---|---|
| ***E21B 10/14*** | (2006.01) |
| ***E21B 10/42*** | (2006.01) |
| ***E21B 10/43*** | (2006.01) |
| ***E21B 10/10*** | (2006.01) |

(Continued)

(52) U.S. Cl.
CPC ..... *E21B 10/14* (2013.01); *E21B 10/10* (2013.01); *E21B 10/42* (2013.01); *E21B 10/43* (2013.01);

(Continued)

(58) Field of Classification Search
CPC ..... E21B 10/14; E21B 10/55; E21B 10/52; E21B 10/46; E21B 10/50; E21B 10/54;

(Continued)

(56) References Cited

U.S. PATENT DOCUMENTS 4,751,972 A * 6/1988 Jones ..... E21B 10/50 175/336
2008/0179108 A1* 7/2008 McClain ..... E21B 10/43 175/431

(Continued)

FOREIGN PATENT DOCUMENTS

CN 2462066 Y 11/2001
CN 102392605 A 3/2012

(Continued)

*Primary Examiner* — George S Gray
(74) *Attorney, Agent, or Firm* — Novick, Kim & Lee, PLLC; Allen Xue

(57) ABSTRACT

A composite drill bit has one or more scraping-wheel cutting units disposed on fixed-blade. The drill bit comprises a bit body, fixed-blades, and scraping-wheels. The angular deflection of the scraping-wheel is in the range of $20° \leq |\alpha| \leq 90°$. The scraping-wheel cutting unit has a scraping-wheel shaft and a scraping-wheel with cutters disposed thereon. The scraping-wheel cutting unit is disposed on the fixed-blade by a rotary connection.

13 Claims, 18 Drawing Sheets

(51) Int. Cl.

| | |
|---|---|
| ***E21B 10/50*** | (2006.01) |
| ***E21B 10/54*** | (2006.01) |
| ***E21B 10/46*** | (2006.01) |
| ***E21B 10/52*** | (2006.01) |
| ***E21B 10/55*** | (2006.01) |

(52) U.S. Cl.
CPC ..... *E21B 10/46* (2013.01); *E21B 10/50* (2013.01); *E21B 10/52* (2013.01); *E21B 10/54* (2013.01); *E21B 10/55* (2013.01); *E21B 2010/425* (2013.01)

(58) Field of Classification Search
CPC ..... E21B 10/10; E21B 10/43; E21B 10/567; E21B 10/62; E21B 10/573; E21B 10/564; E21B 10/12; E21B 10/42; E21B 2010/425
See application file for complete search history.

(56) References Cited

U.S. PATENT DOCUMENTS

| | | | | |
|---|---|---|---|---|
| 2011/0024197 | A1 | 2/2011 | Centala et al. | |
| 2011/0259150 | A1 | 10/2011 | Hall et al. | |
| 2013/0126247 | A1 * | 5/2013 | Yang | E21B 10/14 175/374 |
| 2013/0292185 | A1 * | 11/2013 | Knull | E21B 10/567 175/408 |

FOREIGN PATENT DOCUMENTS

| | | | | |
|---|---|---|---|---|
| CN | 203201473 | U | 9/2013 | |
| CN | 203201474 | U | 9/2013 | |
| CN | 203201475 | U | 9/2013 | |
| CN | 203201476 | U | 9/2013 | |
| WO | WO-2012006966 | A1 * | 1/2012 | E21B 10/14 |

* cited by examiner

COMPOSITE DRILL BIT

TECHNICAL FIELD

The present invention is related to drilling equipment technologies in petroleum and natural gas, mining engineering, infrastructure construction, geological and hydrological projects. More particularly, it is related to a drill bit.

DESCRIPTION OF THE RELATED ART

Drill bit is a rock-breaking tool in drilling engineering used to break rocks and to form wellbores. Presently, drill bits used in drilling engineering are mainly tri-cone bits and PDC (polycrystalline diamond compact) bits.

Tri-cone bits break rocks mainly by means of crushing. For existing tri-cone bits, the angular deflection is mostly no greater than 5°. When a tri-cone bit is rotating to drill the bottomhole rock, the cone/bit speed ratio (the rotating speed ratio between the cone and the bit body in the drilling process) of the bit is larger than 1, which means the cone rotates relatively fast so that the teeth on it get a short time contacting the bottomhole rock, and accordingly, a series of short slippages are formed on the bottomhole rock by the teeth, thus, the tri-cone bit breaks rock and forms wellbore with its crushing effect. For the service life of a tri-cone bit, the bearing life is one of the main limiting factors.

Nowadays, PDC (polycrystalline diamond compact) drill bits, with high wear resistance, long service life and without moving parts, are more and more widely used in drilling engineering projects with ever larger ratios. Existing PDC bits are mainly fixed-cutter drill bits, polycrystalline diamond compacts (i.e. PDC cutters, aka cutters) are distributed and fixed according to certain patterns as cutting elements on the drill bit body, forming PDC bit cutting structure for rock breaking. For the purpose of timely bringing the removed cutting debris to the surface, and simultaneously cleaning the drill bits as well as cooling the cutters, hydraulic structures are configured for PDC bits. A hydraulic structure typically comprises internal flow channel, external flow channel and jet orifice. Jet orifice, which is also known as nozzle, can be fixed nozzle directly attached to the bit body, or replaceable nozzle mounted on the bit. In order to achieve better work performance for the cutting and hydraulic structures, when design and manufacture a PDC bit, cutters are typically divided into several groups according to certain rules, namely, cutters of the same group being fixed on the same cutter-base. A cutting unit is formed with a cutter-base and those PDC cutters distributed thereon, such a cutting unit is called a fixed-blade cutting unit (with the fixed-blade body being the cutter-base). On the other hand, the grooves between fixed-blades are formed as external flow channel. Such a drill bit is called fixed-blade PDC bit, which is the major structure type of PDC bits.

In the drilling process under ideal working conditions (i.e., the central axes of drill bit and wellbore coincide with each other), the rock-breaking areas of cutters on the PDC bit are a series of certain concentric rings on the rock. For such fixed-blade PDC bits, there are mainly four disadvantages:

First, when PDC cutters continuously cutting bottomhole rock, the temperature of the cutters can increase to a very high level with the heat generated by intense friction, when the temperature exceeds a certain level, the wear rate of PDC cutters will be sharply increased, causing the thermo-wear effect (i.e., when the working temperature of PDC cutters exceeds a certain level, the cutters wear resistance decreases significantly, such phenomenon is called thermo-wear effect of PDC cutters).

Second, the failure (dropping-off, cracking or excessive wearing, etc.) of an individual cutter will significantly increase the work load of those PDC cutters adjacent to the rock-breaking ring area of the disabled one, increasing wear rate of these cutters, and furtherly causing premature failure for the drill bit.

Third, the wear rates of PDC cutters located in different radial areas vary significantly, typically, the cutters wear rate in the outer area (especially those located in the outer ⅓ radial area) of the drill bit is dramatically higher than those in the central area.

Last, with more cutters being fixed on the PDC bit, the working load of each cutter can be reduced, thus decreasing the wear rate for the cutters and increasing the service life for the bit, nevertheless, more cutters being fixed will result in a lower rock-breaking efficiency for the bit.

A China Patent (Application No.: CN201010229371) has disclosed a composite drill bit configured with rolling wheels (also known as scraping-wheels, wherein cutters are disposed thereon) and fixed-blade cutting units (wherein cutters are disposed on those blades). In this composite drill bit, the advantages of the scraping-wheel and the fixed-blade are combined together and complement each other, furtherly, combination of them has derived a new rock-breaking method that has achieved a great technical effect. However, this composite drill bit, in the further research, has exposed the following disadvantages: in spite of the good performance achieved respectively from scraping-wheels and fixed-blade cutting units, the scraping-wheel and its requisite independent supporting structure have inevitably occupied a big space in the bit, resulting in compromising on bit performance under limited space condition for cutter distributing. As an unfavorable factor for the design of cutting structure of the bit, this disadvantage has limited the application value of this technology.

SUMMARY OF THE INVENTION

The purpose of the present disclosure is to provide a composite drill bit with scraping-wheel cutting structure disposed on fixed-blade, thus taking better advantage of the structural characteristics of fixed-blade drill bit, and furtherly improving the overall performance of the bit by saving geometric space for cutting structures.

A technical scheme of the present invention is as the following:

A composite drill bit with a scraping-wheel cutting structure disposed on the fixed-blade comprising: a drill bit body, a fixed-blade and a scraping-wheel. The fixed-blade with cutters fixed thereon is formed on the bit body. The angular deflection of the scraping-wheel is in the range of $20° \leq |\alpha| \leq 90°$. At least one scraping-wheel cutting unit, which comprises the scraping-wheel shaft and the scraping-wheel with cutters disposed thereon, is configured on the bit body. At least one scraping-wheel cutting unit is disposed on the fixed-blade forming a rotary connection.

In the structure disclosed above, the angular deflection of the scraping-wheel $$\alpha = \arctan\left(\frac{s}{c}\right),$$

in which s is the offset distance of the scraping-wheel, c is the arm of journal root center of the scraping-wheel. As illustrated in FIGS. 3, 4, 5, 6 and 7, AB is the central axis of the bit body, CD is the central axis of the scraping-wheel, $A_1$ is the polar axis plane of the scraping-wheel which contains scraping-wheel axis CD and is parallel with drill bit axis AB, $A_2$ is a plane which contains drill bit axis AB and is perpendicular to the scraping-wheel polar axis plane $A_1$, $A_3$ is a plane which contains drill bit axis AB and is parallel to the scraping-wheel polar axis plane $A_1$. The points on the scraping-wheel which represent the location coordinates of cutters are the set points of corresponding cutters. Particularly, the set point of a cylindrical PDC cutter is the central point of the working surface of the cutters, set points of other types of cutters are set on certain points of the cutters. Generally, cutters on the scraping-wheel are distributed in the form of circles. The plane $A_4$, which contains all set points of the cutters on the external cutters ring, is the datum plane of the scraping-wheel, the datum plane $A_4$ of the scraping-wheel and scraping-wheel axis CD intersect at point E, and the intersection point E is the datum point of the scraping-wheel. Draw a perpendicular line through point E and toward drill bit axis AB, the pedal point is F. The arm of journal root center c is the distance between the datum point E and $A_2$ plane; disc-cutter offset distance s is the distance between drill bit axis AB and the polar axis plane $A_1$ of the disc-cutter; viewing through the scraping-wheel axis from the disc-cutter toward the thread direction of the drill bit connector (i.e., viewing in the opposite direction of drilling), the angular deflection α of the disc-cutter is defined as the angle between line EF and plane $A_3$, that is, angular deflection $$\alpha = \arctan\left(\frac{s}{c}\right),$$

and the range of angular deflection α is 0-90° (including 0° and 90°). According to the deflect direction, the angular deflection could be either positive or negative, it is further provided that viewing towards the opposite direction of drilling and placing point E under plane A3 (as illustrated in FIGS. 6 and 7), now the angular defection is positive if point E is located on the left side of plane A2 (as illustrated in FIG. 6), otherwise, the angular defection is negative (as illustrated in FIG. 7). Particularly, The angular defection is 0° if point E is located on plane A3, while the angular defection is ±90° if point E is located on plane A2. When absolute value of the angular defection equals to 90°, the actual effects resulted from positive and negative angular deflection are the same. The journal angle β of the scraping-wheel is defined as the angle between scraping-wheel axis CD and the plane that perpendicular to the drill bit axis AB.

For the angular deflection $$\alpha = \arctan\left(\frac{s}{c}\right),$$

as |α| gets larger, more obvious the scraping profile will be shaped in the bottomhole by the scraping-wheel cutters. When α is in the range of $20° \leq |\alpha| \leq 90°$, cutters on the scraping-wheel will break rocks through slow alternate cutting, the larger α is, slower the scraping-wheel will rotate, resulting in a lower alternate frequency for the cutters on the scraping-wheel.

The scraping-wheel cutting structure in the present invention comprises a scraping-wheel and the cutters disposed thereon.

In the present invention, fixed-blade could either be formed from or be welded on the drill bit body. The scraping-wheel could be fitted on or be formed as an integrated structure with the scraping-wheel shaft. The scraping-wheel, on the other hand, is disposed on the fixed-blade forming a rotary connection through the scraping-wheel shaft. As drill bit technology being developed all these years, basic structure of elementary units (such as fixed-blade, roller cone and rolling wheel etc.) is nearly mature. Habitual thinking in this technical field always tend to combine different functions of these units by simply attaching them but not hybridizing them together so that different units are not affected or complemented by each other. Differently, the present invention disposes scraping-wheel on fixed-blade forming a hybrid structure, thus the supporting structure for the scraping-wheel (i.e. bit leg) can be eliminated so as to save more space in the bit.

In one embodiment of the present invention, the scraping-wheel is disposed in front or at the back of the fixed-blade with one end of the scraping-wheel shaft being fixed with the scraping-wheel and the other end forming a rotational connection with the fixed-blade.

In spite of the habitual thinking of combining independent units by simply attaching them together, the present invention disposes the scraping-wheel on the fixed-blade forming a hybrid structure, thus the supporting structure of the scraping-wheel (i.e. bit leg) is eliminated. Besides, this combination method, on the basis of saving space in the bit, has furtherly achieved more derivative benefits: since the fixed-blade is furtherly designed to be supporting structure for the scraping-wheel, the structures of the scraping-wheel and its shaft, as well as the combination mechanism between them, changes obviously from the existing structure. As illustrated in FIG. 1, the bit leg of existing structure is compelled to be bulky to meet the strength and rigidity requirements. Besides, axial size of the scraping-wheel of existing structure must be large enough to achieve a reasonable contact area for the bearing, otherwise too narrow a contact area will bring an undesirable stress condition for the bearing system, which will finally result in a camber wear for the bearing. In the present invention, as illustrated in FIG. 2, with the fixed-blade acting as the single supporting structure for the scraping-wheel, the bit leg is eliminated and the rotary connection between the scraping-wheel and the fixed-blade could be directly disposed within the fixed-blade, thus sizes (thickness in especial) of the scraping-wheel can be largely reduced.

In one embodiment of the present invention, the scraping-wheel is disposed in front or at the back of the fixed-blade, with one end of the scraping-wheel shaft forming a rotary connection within the scraping-wheel and the other end being fixed on or forming an integrated structure with the fixed-blade.

In one embodiment of the present invention, the fixed-blade is placed in scraping-wheel slots, one end or both ends of the scraping-wheel shaft are mounted on the fixed-blade, and the rotary connection between the scraping-wheel and the fixed-blade is formed on the shaft.

In the embodiment, the fixed-blade is placed in scraping-wheel slots extending from the top towards the root of fixed-blade. The slots could be set in front or at the back of the fixed-blade. Besides saving the space of bit, the structure disclosed in present invention has furtherly achieved more derivative benefits:

For the existing technology, both the bearings of tri-cone bit and the bit in the China Patent CN201010229371 are of single supporting structures, wherein one end of the bearing journal is fixed on the bit leg while the other is free, structurally forming a cantilever beam. The cone or the scraping-wheel is mounted on the free end to form a rotary connection with the drill bit body, therefore, in order to prevent the cone or the scraping-wheel from falling off or axially moving along the journal, an axial locking device (such as ball-locking) is required to be set between the cone and the journal. Accordingly, as essential parts of the axial locking device, ring grooves must be machined in both the journal and the cone, thus, both the strength of the cone and the journal, as well as abrasive resistance of the bearing, will inevitably be reduced. On the other hand, even equipped with the axial locking device, the cone or scraping-wheel cannot be ensured from falling off, once the failure of the axial locking device occurs and furtherly results in the cone or the scraping-wheel falling off the journal, the drilling process will be terribly impeded. Moreover, the shaft and the bit-leg of this structure can only be designed as an integrated structure, which restricts the structure design of the bearing system rigorously. Altogether, the above disadvantages of the existing structure affects the bit performance unfavorably.

In the embodiment of the present invention, with the scraping-wheel being fitted in the scraping-wheel slot, the advantages are:

First, the volume of scraping-wheel and its supporting structure can be significantly reduced, so that space in the bit body can be saved to provide a favorable condition for achieving a better bit performance. On one hand, this structure provides more space and choices for cutter distribution, especially for the bit drilling in the hard formation, thus it is favorable to bit life and drilling efficiency. On the other hand, this structure enables the bit to be smaller and more compact, which is favorable to the application of the bit in deep-hole and slim-hole wells drilling.

Second, with the fixed-blade being disposed with scraping-wheel of large angular deflection, the cutters thermo-wear effect on existing PDC bit is significantly reduced by the alternate cutting of scraping-wheel cutters, thus increasing the rock-breaking efficiency for the bit.

Third, in the cutter distribution surface of the bit, the space allocated for scraping-wheel cutters is equivalent to that for a row of fixed cutters on the blade, in other words, cutters on a scraping-wheel has just replaced one row of cutters on the fixed-blade without taking extra space.

Forth, the end face or side surface of the scraping-wheel slot is able to prevent axial movement for the scraping-wheel, moreover, the scraping-wheel of larger radius is yoked in the middle of the scraping-wheel shaft of smaller radius, this structure, together with the limitation of scraping-wheel slot, can effectively prevent the scraping-wheel from falling off the bit, and the axial locking device can be given up to release more bearing space. On one hand, a scraping-wheel supporting structure without axial locking device is favorable for the strength and abrasive resistance of the bearing, on the other hand, for bearings of the same size, bearing strength of the present design is enhanced and the load on the scraping-wheel shaft is evener, thus achieving a longer bearing service life. Altogether, compared with the existing bearing system, the scraping-wheel bearing system of the present invention is safer, more reliable and durable.

Fifth, compared with existing technology, the scraping-wheel of the present invention is disposed on the bit with double-supporting structure, so that the wheel or cone shell thickness corresponding to the free end of the shaft journal as well as the space reserved for avoiding the collision between scraping-wheel and fixed-blade can be eliminated, thus the combination of scraping-wheel and fixed-blade is more compact, and more space in the bit is spared to provide favorable conditions for cutter distribution and structural design of the bit.

Sixth, structure of the present invention realizes the combination of fixed-blade and scraping-wheel cutting units with a more reasonable and efficient method, that is, hybridizing two cutting patterns of both units with each other to form cross-cutting or mesh-like pattern in the bottomhole so that cutters will penetrate in rocks more effectively, thus decreasing the wear rate of cutters and meanwhile increasing the rock-breaking efficiency of the bit.

Last, comparing the bit in present invention with that of existing technology, smaller WOB is needed, which will result in a lighter load and smaller load fluctuation on the bearing. On the other hand, the wheel/bit speed ratio is lowered so that the relative rotation speed of the bearing is accordingly lowered and less heat is generated. Moreover, for structures of the same size, bearing strength of the present invention is larger and stress on the scraping-wheel shaft is evener, thus achieving a longer service life for the bearing. Altogether, the bearing of the present invention is more durable than the tri-cone bit of the same size.

In one embodiment of the present invention, the scraping-wheel forms a rotary connection with its shaft of which both ends are disposed on fixed-blades with rotary connections.

In the embodiment, a bearing is set between the scraping-wheel and its shaft, likewise, bearings are also respectively set between both shaft ends and the fixed-blades. Apparently, the relative rotation speed between scraping-wheel and fixed-blade is the sum of the rotation speed of the scraping-wheel relative to its shaft and that of the shaft relative to the fixed-blade, so that the rotation speed of scraping-wheel relative to its shaft, as well as that of the shaft relative to the fixed-blade, is significantly reduced, thus lowering the wear rate and lengthening the service life for the bearing.

In one embodiment of the present invention, at least one end of the scraping-wheel shaft is fixed on the fixed-blade, and the shaft forms a rotary connection with the scraping-wheel.

In the embodiment, the scraping-wheel keep a rotary connection with the scraping-wheel shaft, and one end of shaft is fixed on the fixed-blade while the other one just fitted with the fixed-blade (i.e. neither fixed connection nor rotary connection, fixed-blade just support and hold the shaft end from unexpected movement, for example, the simplest structure is that the fixed-blade is machined with a hole that fit with the shaft end), or differently, both ends of the shaft are fixed within the fixed-blade through keys, splines or interference fit etc. In this structure, the rotary connection is set between the scraping-wheel and its shaft, which is more favorable for bearing manufacturing than the structure with rotary connection being set between the shaft and fixed-blade.

In one embodiment of the present invention, the scraping-wheel is fixed with its shaft of which both ends are disposed on the fixed-blade forming rotary connections respectively.

In one embodiment of the present invention, at least one row of cutters on the fixed-blade are fixed in front and/or at the back of the scraping-wheel.

In one embodiment of the present invention, the fixed-blade is machined with two scraping-wheel slots of which one is in front of the fixed cutters and the other one at the back, each slot is disposed with one scraping-wheel.

In one embodiment of the present invention, the bit body is configured with independent fixed-blade cutting unit consisting of independent fixed-blade and cutters fixed thereon.

In the embodiment, the independent fixed-blade is the one disposed without scraping-wheel, which should be distinguished from the one disposed with scraping-wheels. When drilling in the formation, independent fixed-blade cutting unit and the scraping-wheel cutting unit act together to form cross-cutting and mesh-like pattern in the bottomhole so as to make more complex cutting tracks.

In one embodiment of the present invention, at least two scraping-wheel cutting units are disposed on the bit, and the radial position of at least one scraping-wheel on the bit differs from that of the others. Furtherly, diameters of at least two scraping-wheels with different radial position on the bit are not equal.

In the embodiment, scraping-wheels of different radial positions take different cutting area, thus distributing the working area for each scraping-wheel more reasonably.

In one embodiment of the present invention, at least two scraping-wheel cutting units are disposed on the bit, and the angular deflection of at least one scraping-wheel differs from that of the others.

In the embodiment, scraping-wheels with different angular deflections form different cutting tracks in the bottomhole, and hybridization of different cutting tracks realizes the cross-cutting pattern for the bit.

In one embodiment of the present invention, diameters of at least two scraping-wheels are not equal. Furtherly, diameters of two scraping-wheels with different angular deflections are not equal.

In one embodiment of the present invention, at least two scraping-wheel cutting units are disposed on the bit, wherein at least one scraping-wheel is disposed with positive offset and at least one with negative offset. Furtherly, the absolute values of the angular deflection of at least two scraping-wheels with opposite offset are equal.

In the embodiment, the bit is configured with scraping-wheel cutting units of both positive and negative offset, accordingly, spiral-like cutting patterns from edge to center and center to edge are respectively scrapped on bottomhole rock by scraping-wheel with positive and negative offset. Two sets of cutting patterns intersect with each other forming a mesh-like pattern in the bottomhole. For an ordinary scraping-wheel bit, the angular deflections of scraping-wheels are equal to each other so that only non-intersecting spiral-like tracks are formed in the bottomhole. Unlikely, scraping-wheels with different angular deflections form spiral-like patterns of different directions, and accordingly a mesh-like cutting tracks and a more rugged cutting pattern is scraped, which is favorable for the cutters penetrating in the bottomhole rock and increasing the rock-breaking efficiency. On the other hand, as the existence of both positive and negative offset scraping-wheel cutting units makes the bottomhole rock more rugged, the time and length of continuous cutting is reduced for the cutters, thus achieving a better cooling performance for the cutters and accordingly lengthening the service life for the bit. Furtherly, for two scraping-wheels with opposite offset, if the absolute values of the angular deflection are equal, the cutting profiles of the two scraping-wheels will be easily matched, which is furtherly favorable to match the profiles of scraping-wheel cutting units and fixed-blade cutting units, thus achieving a better rock-breaking performance for the bit.

In one embodiment of the present invention, at least two scraping-wheel cutting units are disposed on the bit, the cutting profile of at least one scraping-wheel is lower than the other cutting profiles.

In the embodiment, with the cutting profiles of scraping-wheels being lower than the other cutting profiles, scraping-wheels of lower position will not take part in rock-breaking process until the other cutters are worn to a certain degree, in other words, scraping-wheels of lower position function as backup cutting units for the bit, making the bit more durable.

In one embodiment of the present invention, at least one scraping-wheel is disposed with at least two circles of cutters, wherein, the profile of one cutters circle matches with that of the fixed-blade cutting units, while profile of the other cutters circle is disposed lower than that of the fixed-blade cutting unit.

In the embodiment, for the cutters on the scraping-wheel of which the cutting profiles are lower than that of the fixed-blade cutting unit, they will not take part in rock-breaking process until the cutters on fixed-blade cutting unit are worn to a certain degree, in other words, some of the cutters on the scraping-wheel are designed to be main cutting elements, while the other cutters on scraping-wheel function as backup cutting elements for the bit, making the bit more durable.

In one embodiment of the present invention, the cutting profile of at least one scraping-wheel is positioned higher than that of the fixed-blade cutting unit.

Since cutters on the scraping-wheel break rock by alternate cutting, the actual working time of each cutter is obviously shorter than that of the cutters on the fixed cutting structure, the cutters achieve a better cooling performance so that it is unlikely for the cutters to have thermo-wear effect occurred. When working under the same load condition, wear rate of the cutters on scraping-wheel is remarkably lower than that of the cutters on fixed cutting structure. With the cutting profile of scraping-wheel being positioned higher than the fixed-blade cutting unit, cutters on the scraping-wheel take more working load, so that the cutters on fixed cutting structure achieve a favorable condition for penetrating and breaking bottomhole rock. Particularly, when drilling in inhomogeneous formation such as soft-hard interphase layer, cutters on scraping-wheel will precede to contact the interlayer, thus protecting the cutters on fixed cutting structure and achieving evener wear for all the cutters, and consequently, lengthening the service life and increasing the drilling speed for the bit.

In one embodiment of the present invention, at least one scraping-wheel cutting unit is disposed with cutters of different diameters.

In the embodiment, with cutters of different diameters being disposed on the same scraping-wheel, the scraping-wheel achieves stronger adaptability to different formations (generally, scraping-wheel with smaller cutters is more applicable to hard formation while the one with bigger cutters is more applicable to soft formation), on the other hand, the main cutting structure and backup cutting structure (generally, the bigger cutters act as main cutters while the smaller ones function as backup cutters) can be simply configured on the same scraping-wheel.

In one embodiment of the present invention, at least one scraping-wheel is disposed with at least two circles of cutters.

In the embodiment, two circles of cutters are disposed on the same scraping-wheel, wherein, one circle is in the front while the other at the rear of the scraping-wheel. Advantages of this structure are: First, if both circles comprise main cutters, then cutters of different circles are disposed on the periphery of the wheel with a staggered arrangement, so that coverage density of the cutters on the scraping-wheel is greatly increased, which is favorable for cutting the rock ridge as well as lowering the load on each cutter, thus the bit performance in hard formation is improved. Second, with one of the circles being disposed with main cutters while the other one being disposed with backup cutters in the condition of high cutter-distribution density, both main cutting structure and backup cutting structure could be configured on the same scraping-wheel, so as to make the bit more durable when drilling in hard formation.

In one embodiment of the present invention, scraping-wheel of at least one scraping-wheel cutting unit is disposed with cutters of non-circular section.

In the embodiment, cutters of non-circular section disposed on the scraping-wheel are divided into two types: cutter with width and length of its section being unequal (such as ellipse section cutter), and cutters of which the section boundary being shaped with salient point or salient area (such as wedge-shaped cutter). Cutter of the former type is disposed on the scraping-wheel with its length direction of the section being aligned with the radius of the wheel, thus lengthening the usable area for the cutters as well as improving the cutting performance of the scraping-wheel. For cutters of the latter type, the salient point or salient area should be positioned outwardly along the radius direction of the wheel, thus significantly improving the cutting performance of the scraping-wheel.

EMBODIMENTS

The present disclosure is further illustrated in details in reference to the following figures. It is to be noted that the figures illustrates only some embodiments of the invention and therefore are not to be considered limiting of its scope as the invention may admit to other equally effective embodiments.

Embodiment 1

Figure 1:
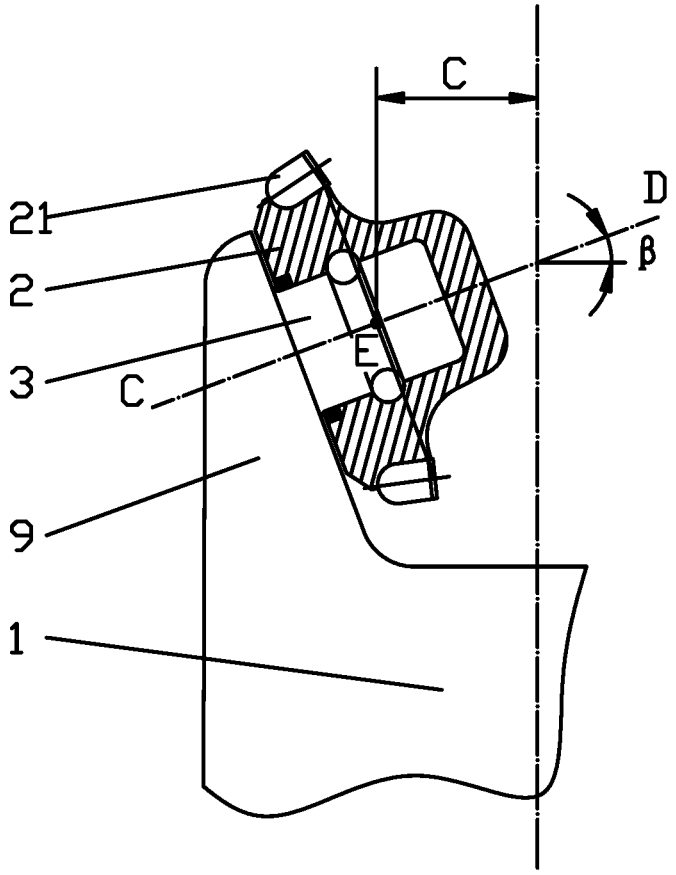
FIG. 1 is a schematic drawing of the rotary connection between the scraping-wheel and its shaft of existing technology.
Figure 2:
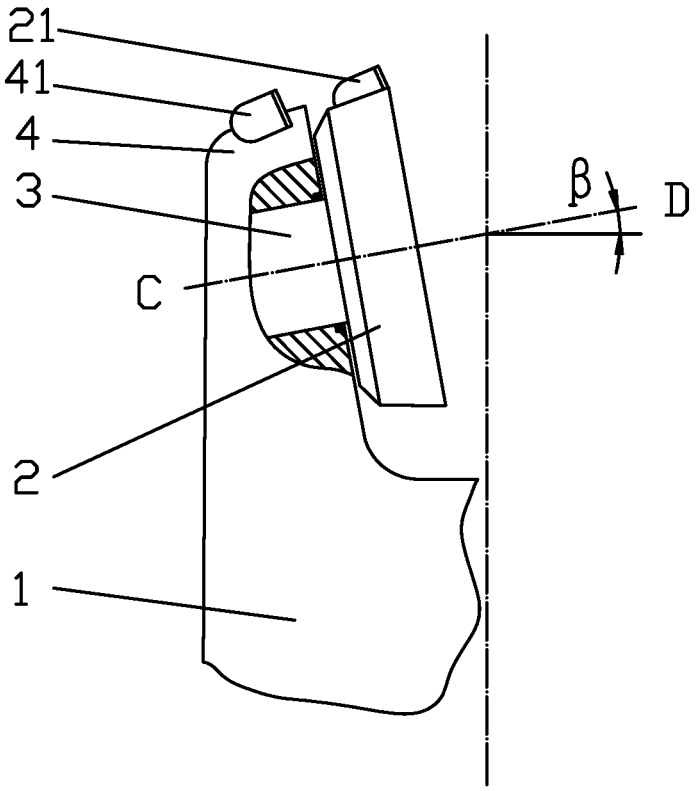
FIG. 2 is a schematic drawing of the rotary connection between the scraping-wheel (being disposed in front of the fixed-blade) and fixed-blade of an embodiment in present invention.
Figure 3:
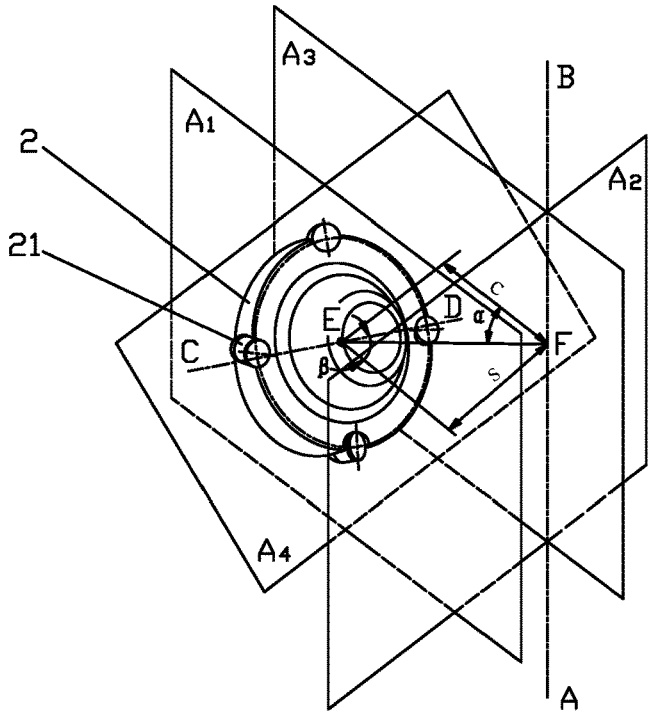
FIG. 3 is a schematic drawing showing the geometric parameters of the scraping-wheel: offset distance s, arm of journal root center c, angular deflection $\alpha$ and journal angle $\beta$ of an embodiment in present invention.
Figure 4:
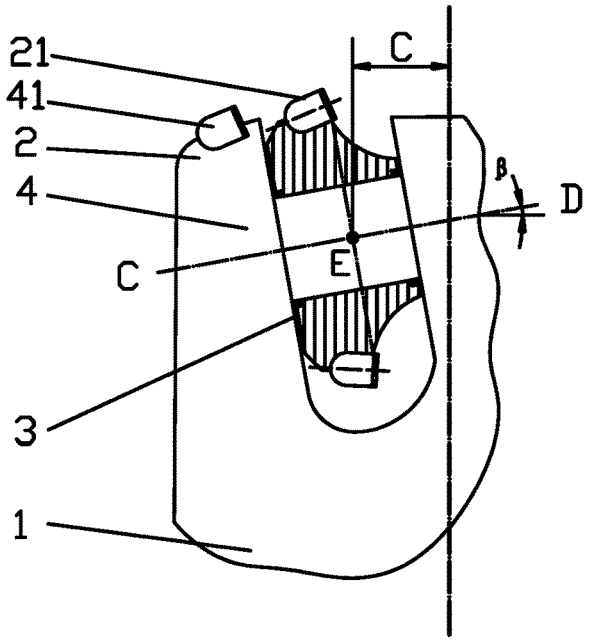
FIG. 4 is a cross-section taking along the polar axis plane of the scraping-wheel, showing the rotary connection between the scraping-wheel and its shaft (of which both ends are fixed on the fixed-blade) of an embodiment in present invention.
Figure 5:
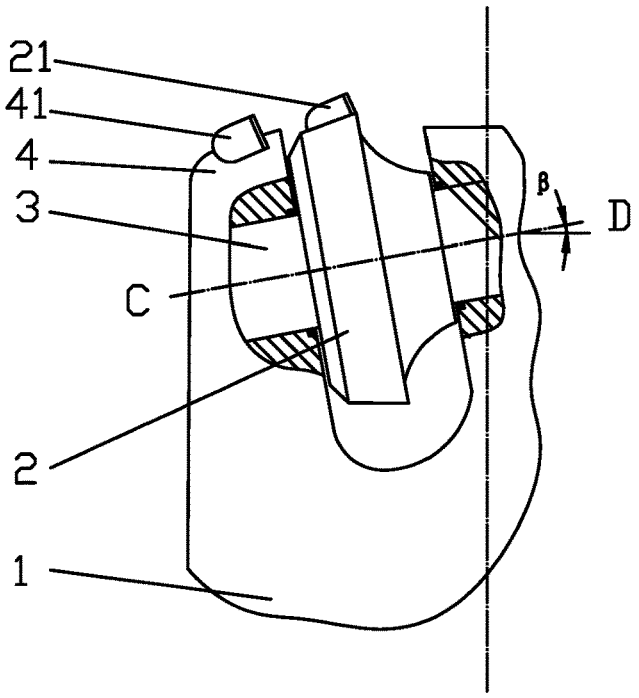
FIG. 5 is a break-out section of the fixed-blade, taking along the polar axis plane of the scraping-wheel, showing the fixed connection between the scraping-wheel and its shaft (of which both ends are disposed on fixed-blades with rotary connection) of an embodiment in present invention.
Figure 6:
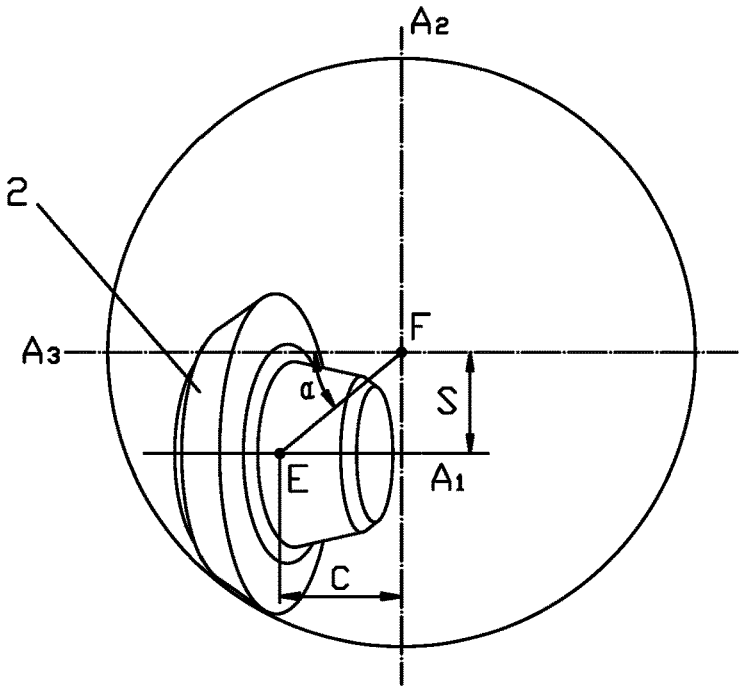
FIG. 6 is a simplified plan view along the bit axis, showing the geometric parameters of relative positions s, c, $\alpha$ of an embodiment in present invention, wherein, the offset and angular deflection of the scraping-wheel are both positive.
Figure 7:
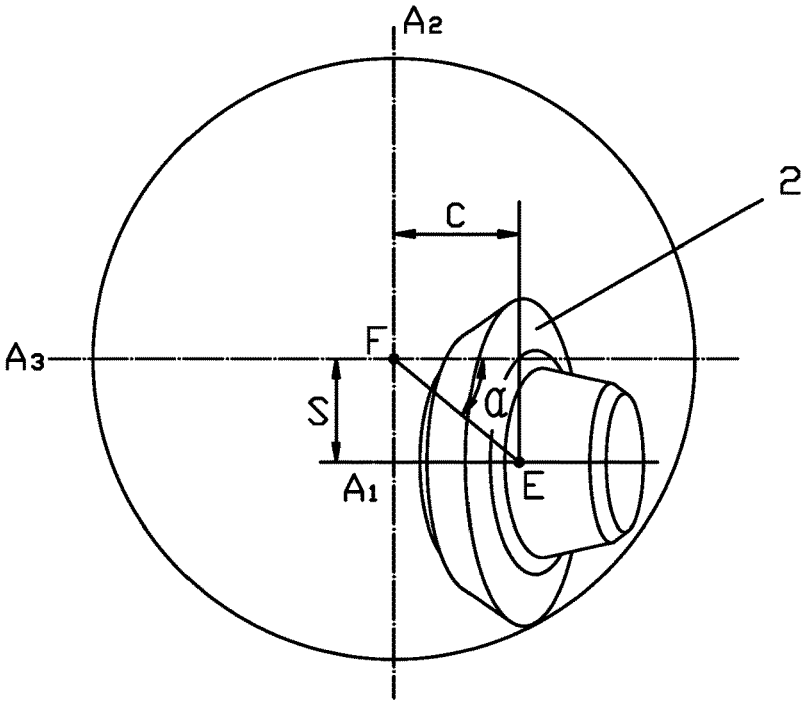
FIG. 7 is a simplified plan view along the bit axis, showing the geometric parameters of relative positions s, c, $\alpha$ of an embodiment in present invention, wherein, the offset and angular deflection of the scraping-wheel are both negative.
Figure 8:
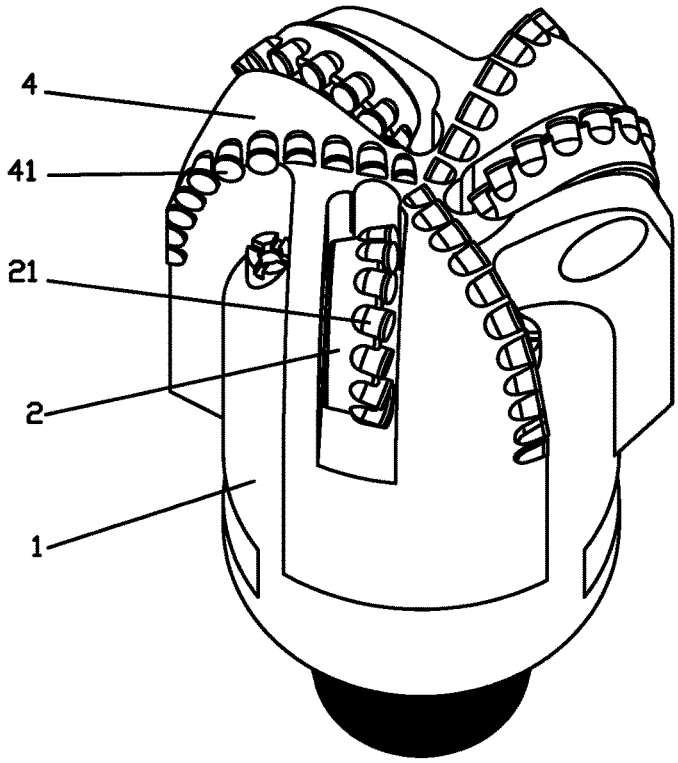
FIG. 8 is a perspective view showing the bit in present invention, wherein, the scraping-wheel is disposed in the slot machined within the fixed-blade which is disposed with one row of fixed cutters.
Figure 9:
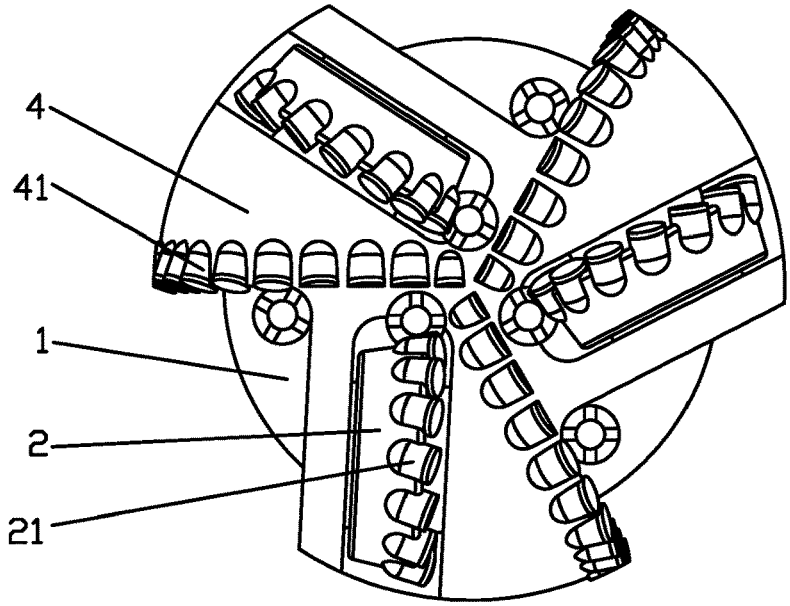
FIG. 9 is a plan view of the bit in FIG. 8 (taking along the bit axis from the cutting structure toward the connector of the bit).
Figure 14:
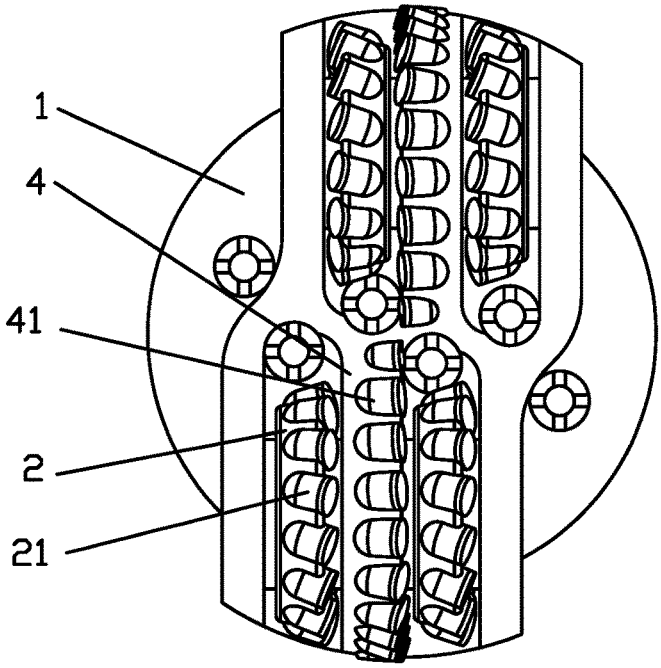
FIG. 14 is a plan view of the bit in present invention, wherein, each fixed-blade is configured with one cutters-row and two scraping-wheels, and the angular deflection of one scraping-wheel is positive while the other one is negative.
Figure 15:
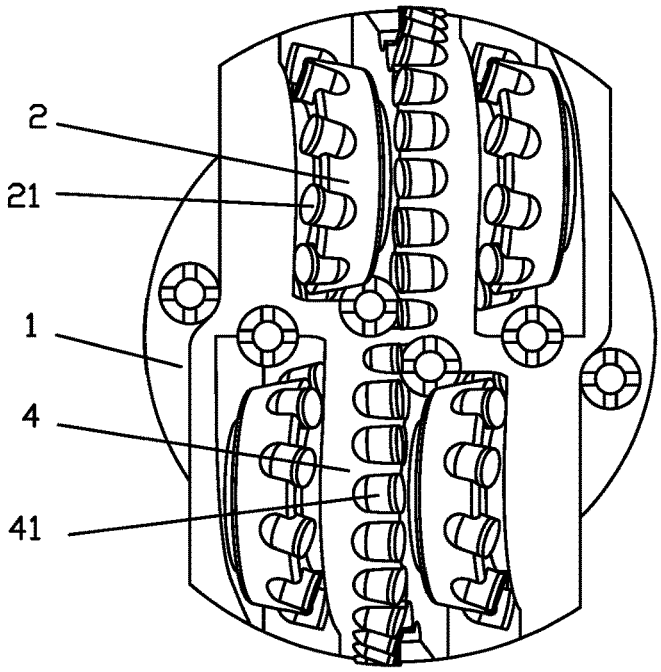
FIG. 15 is a plan view of the bit similar to that in FIG. 14 with only the journal angle of the scraping-wheel being different.
Figure 16:
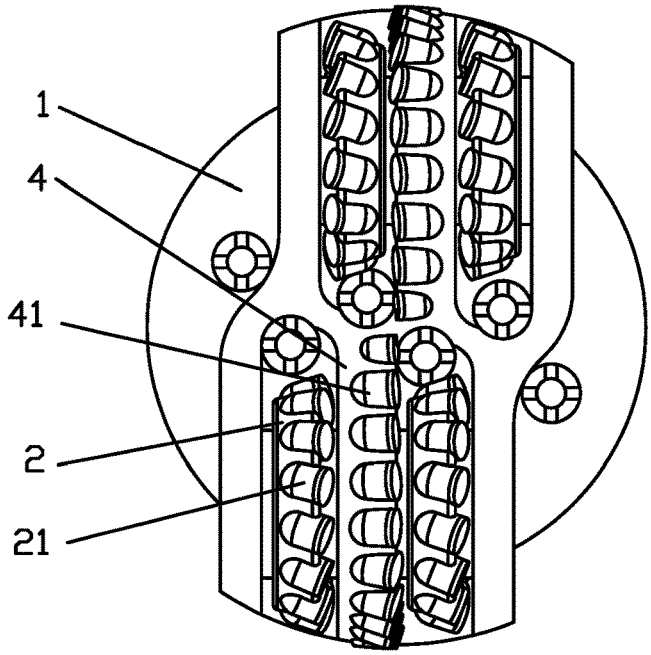
FIG. 16 is a plan view of the bit similar to that in FIG. 14, wherein, the difference is that the fixed-blade is disposed with multiple cutters-rows.
Figure 17:
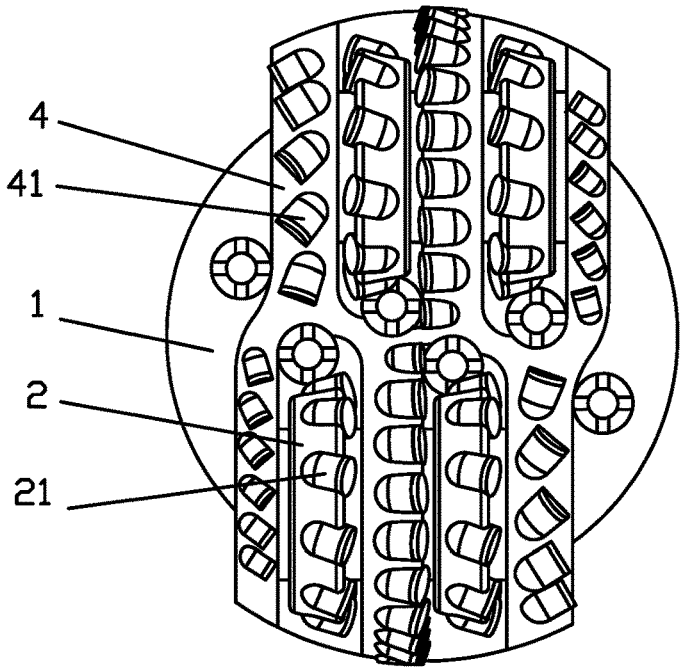
FIG. 17 is a plan view of the bit similar to that in FIG. 16, wherein, the difference is that scraping-wheels are disposed on the fixed-blade with different radial positions of the bit.
Figure 22:
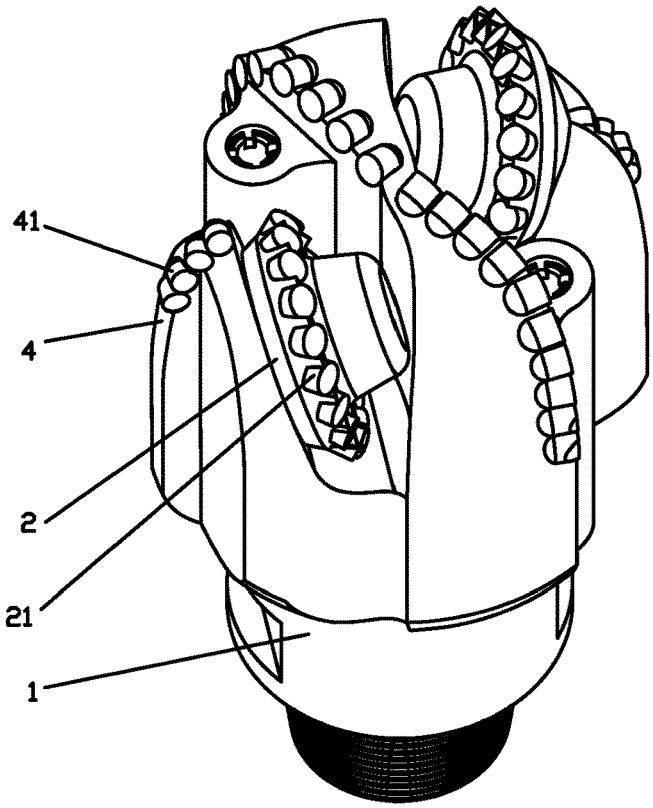
FIG. 22 is a perspective view of the bit similar to that in FIG. 21, wherein, the difference is that independent fixed-blade cutting units are disposed on the bit.
Figure 27:
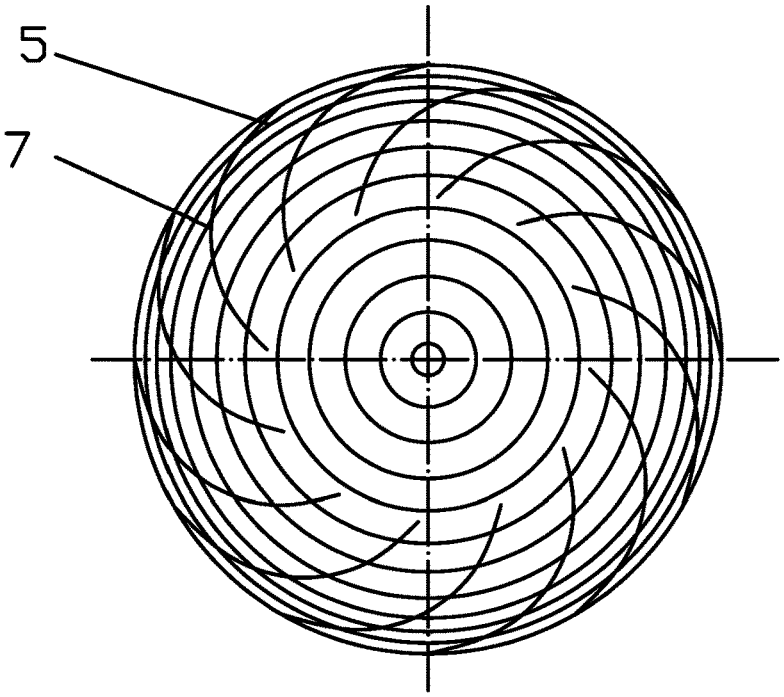
FIG. 27 is a schematic drawing of the mesh-like cutting pattern created by both scraping-wheel and fixed-blade cutting units of an embodiment in present invention, wherein offset of the scraping-wheel is negative.

As illustrated in FIGS. 3, 4, 5, 6 and 7: A composite drill bit with a scraping-wheel cutting unit being disposed on the fixed-blade, comprising: a bit body (1), a fixed-blade (4) and a scraping-wheel (2). The fixed-blade (4) with cutters (41) fixed thereon is configured on the bit body (1). The angular deflection of the scraping-wheel (2) is in the range of $20° \leq |\alpha| \leq 90°$. At least one scraping-wheel cutting unit, which comprises the scraping-wheel shaft (3) and the scraping-wheel (2) with cutters (21) disposed thereon, is configured on the bit body (1). At least one scraping-wheel (2) is disposed on the fixed-blade (4) forming a rotary connection. The fixed-blade (4) is machined with scraping-wheel slot in which the scraping-wheel (2) is disposed, one end or both ends of the scraping-wheel shaft (3) is disposed on the fixed-blade (4), and the scraping-wheel (2) is disposed on the fixed-blade (4) with rotary connection formed through the scraping-wheel shaft (3). With this structure, volume of the scraping-wheel cutting unit is largely reduced, and fixed-blades (4) in front and at the back of the scraping-wheel (2) could prevent it from axial movement or falling off the bit. For bearings of the same size, the bearing strength is larger and stress on the scraping-wheel shaft (3) is evener than the existing design (as illustrated in FIG. 1), so that the scraping-wheel bearing system of the present invention is safer, more reliable and more durable. The scraping-wheel (2) is disposed on the fixed-blade (4) with rotary connection through scraping-wheel shaft (3), among multiple connection methods, there are several priorities: First, as illustrated in FIG. 5, the scraping-wheel (2) is fixed on the scraping-wheel shaft (3) (through keys, splines or interference fit or even being formed as an integrated structure with each other etc.), and the scraping-wheel shaft (3) is disposed on the fixed-blade (4) with rotary connection, so that the scraping-wheel (2), together with the shaft (3), is able to rotate relative to the fixed-blade (4). Second, the scraping-wheel (2) is disposed on the scraping-wheel shaft (3) with rotary connection, and at least one end of the shaft (3) is fixed on the fixed-blade (4) (as illustrated in FIG. 4). Third, the scraping-wheel (2) is disposed on the scraping-wheel shaft (3) with rotary connection, both ends of the shaft (3) are fixed on the fixed-blade (4), and at least one circle of cutters (41) are fixed in front and/or at the back of the scraping-wheel (2). As illustrated in FIGS. 8, 9, 12 and 13, the fixed-blade (4) is configured with one to maximum three rows of cutters (41), making the bit more adaptable for drilling in hard and abrasive formation. As illustrated in FIG. 14, the fixed-blade is machined with two scraping-wheel slots extending from the top towards the root of it, wherein one slot is in front of the fixed cutters (41) and the other one at the back, and each slot is disposed with one scraping-wheel (2). As illustrated in FIG. 15, is a bit similar to the one in FIG. 14 with only the journal angle of the scraping-wheel (2) being different. As illustrated in FIG. 16, is a bit similar to the one in FIG. 14, wherein cutters (41) are disposed on the fixed-blade (4) in front of, at the back of and between the scraping-wheels (2). As illustrated in FIG. 17, is a bit similar to the one in FIG. 16, wherein the polar axis planes of the two scraping-wheels (2) on the same fixed-blade (4) are different. The combination of fixed cutters (41) and scraping-wheel cutting unit forms cross-cutting area in the bottomhole, which is of benefit for cutters effective penetrating in rocks, thus lowering the wear rate of cutters and increasing rock-breaking efficiency for the bit. FIG. 22 illustrates the mesh-like bottomhole pattern scraped by fixed cutters (41) and scraping-wheels with positive offset (as the structures illustrated in FIGS. 8, 9 and 13). FIG. 6 illustrates the concentric tracks (5) formed by fixed cutters and the spiral-like tracks (6) (from edge to center of the borehole) formed by the scraping-wheel with positive offset. As illustrated in FIG. 27, is the mesh-like bottomhole pattern scraped by fixed cutters (41) and scraping-wheels with negative offset (as the structures illustrated in FIG. 12). FIG. 7 illustrates the concentric tracks (5) formed by fixed cutters and the spiral tracks (7) (from center to edge of the borehole) formed by scraping-wheels with negative offset.

Embodiment 2

Figure 12:
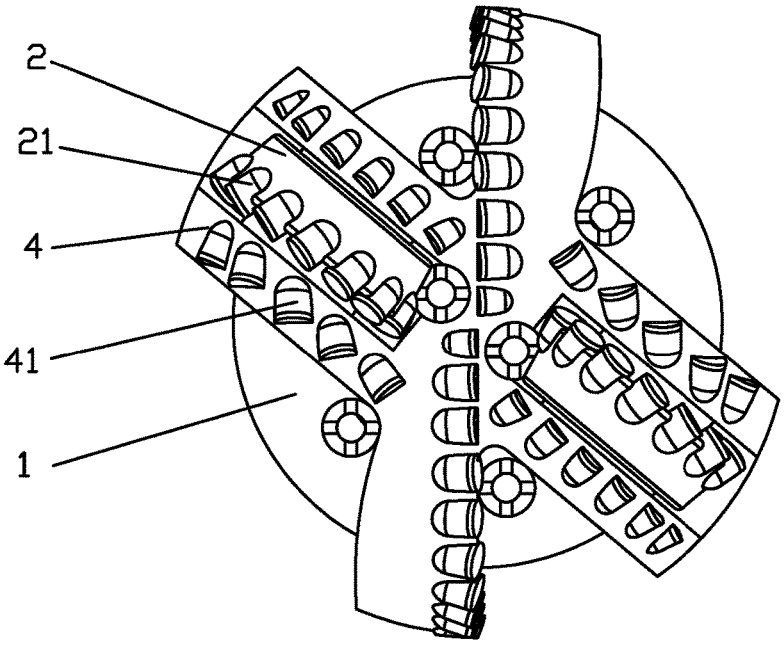
FIG. 12 is a plan view of the bit similar to that in FIG. 8, wherein, the difference is that one cutters-row are disposed both in front and at the back of the scraping-wheel on the fixed-blade.
Figure 13:
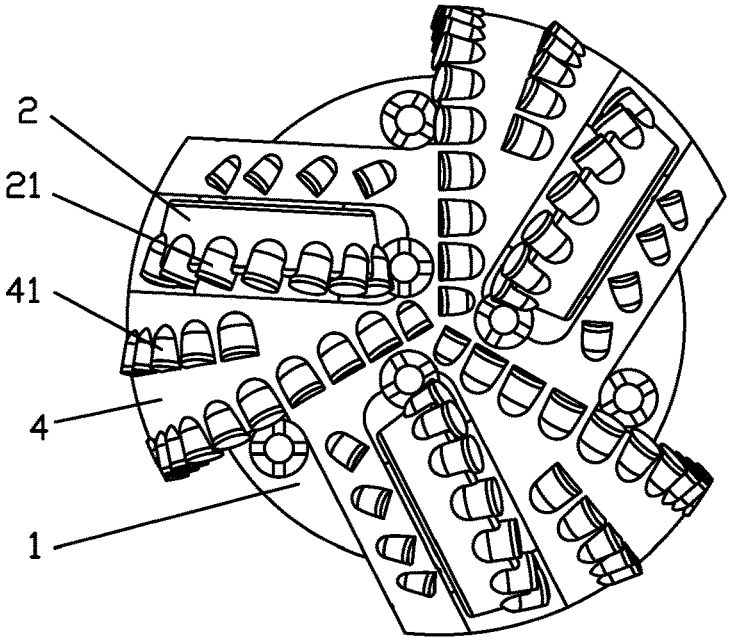
FIG. 13 is a plan view of the bit in present invention, wherein, two cutters-rows are disposed in front of the scraping-wheel while one cutters-row is disposed at the back of the scraping-wheel on the fixed-blade.
Figure 24:
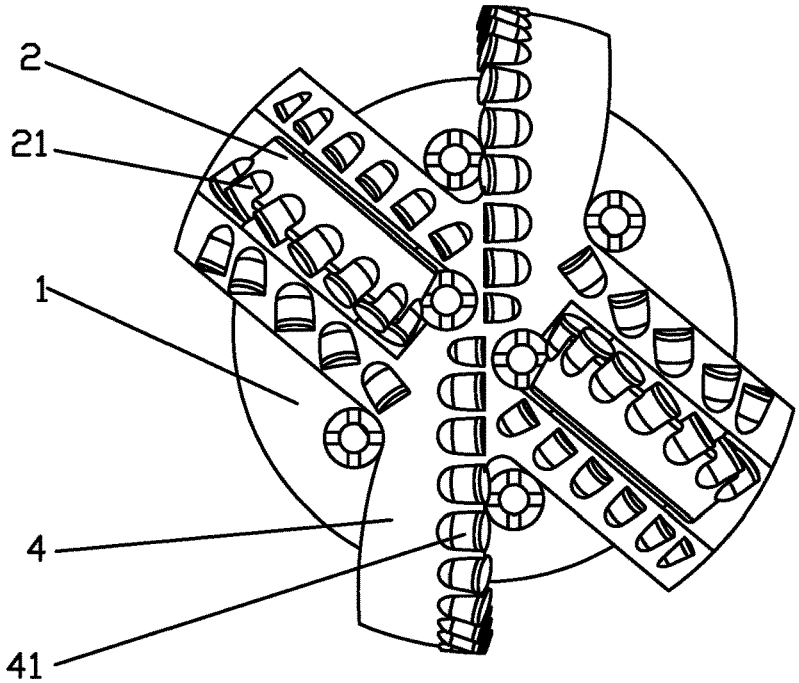
FIG. 24 is a plan view of the bit in present invention, wherein, independent fixed-blade cutting units without scraping-wheels are disposed on the bit.
Figure 25:
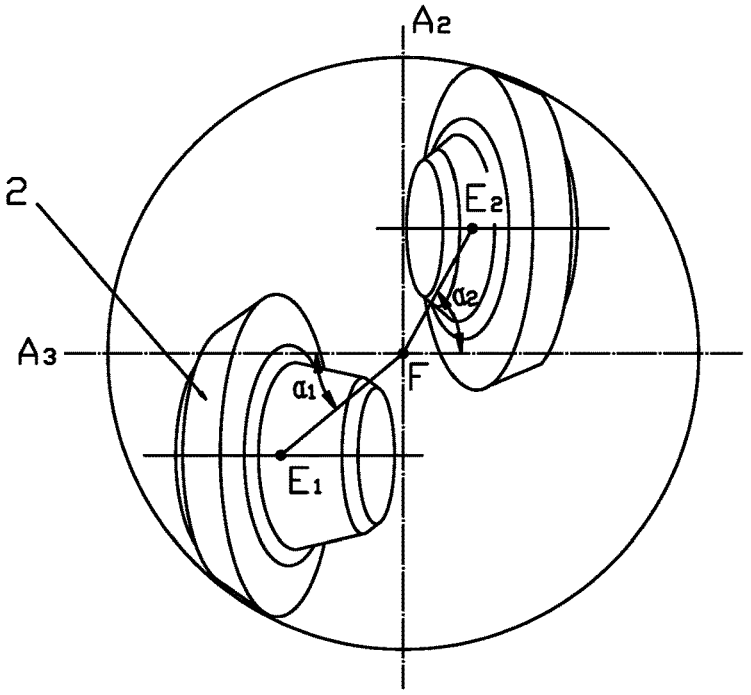
FIG. 25 is a schematic drawing of the bit disposed with scraping-wheels of different angular deflections.
Figure 26:
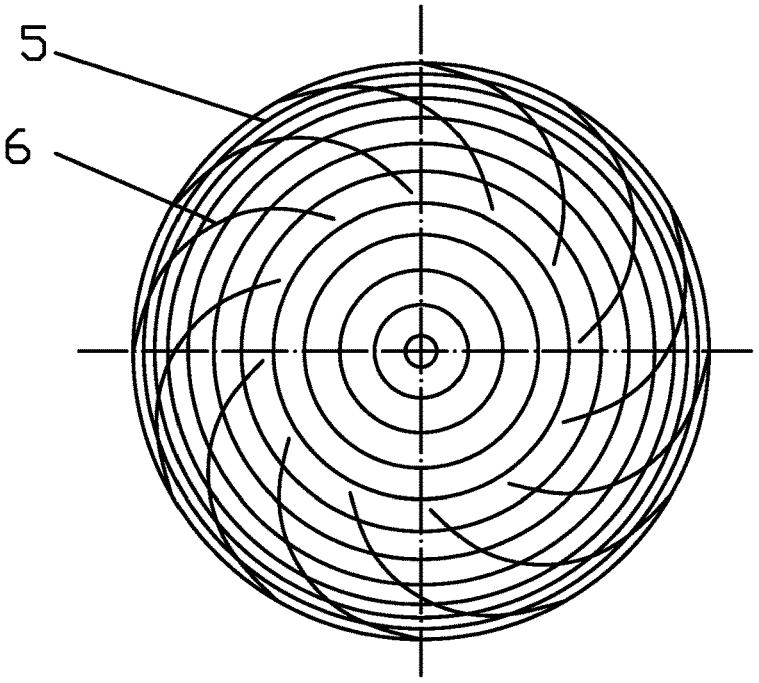
FIG. 26 is a schematic drawing of the mesh-like cutting pattern created by both scraping-wheel and fixed-blade cutting units of an embodiment in present invention, wherein offset of the scraping-wheel is positive.

This embodiment is generally the same as Embodiment 1, as illustrated in FIGS. 12, 22 and 24, wherein, the difference is that the bit body (1) is configured with independent fixed-blade cutting unit which consists of independent fixed-blade (4) and cutters (41) affixed thereon. Furtherly, the fixed-blade (4) disposed with scraping-wheel is configured with one row of cutters (41) (as illustrated in FIG. 22) or two rows of cutters (41) (as illustrated in FIGS. 12 and 24). Moreover, independent fixed-blade cutting unit (4) is disposed on the bit body (1) so that cutters distribution density is increased, making the bit to be more adaptable for the hard and abrasive formation.

Embodiment 3

Figure 28:
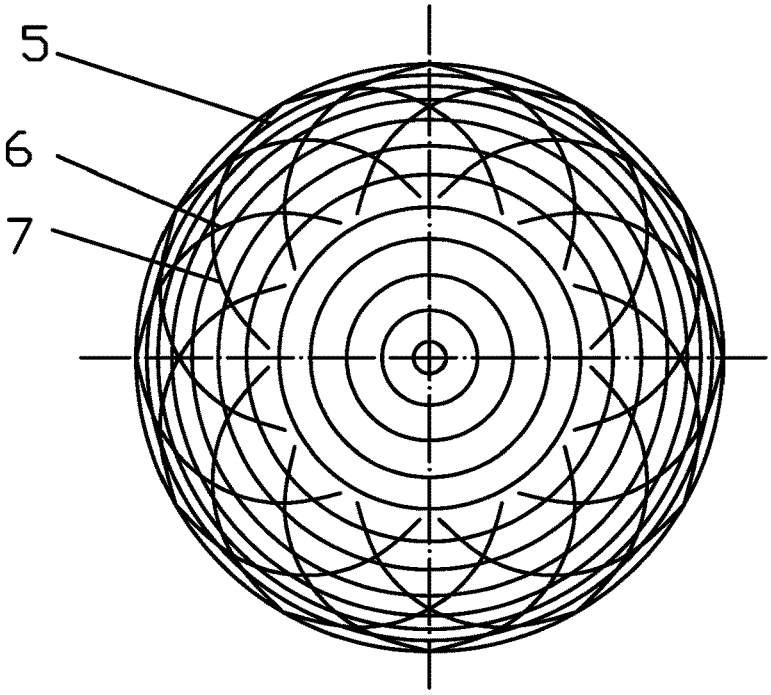
FIG. 28 is a schematic drawing of the mesh-like cutting pattern created by both scraping-wheel and fixed-blade cutting units of an embodiment in present invention, wherein, offset of one scraping-wheel is positive while the other one is negative, and absolute values of the angular deflections of the two scraping-wheels are equal.

This embodiment is generally the same as Embodiment 1 or 2, wherein the difference is that scraping-wheels with both positive and negative offsets are disposed on the bit body (1). As illustrated in FIGS. 14, 15, 16 and 17, since two scraping-wheels (2) are disposed on the fixed-blade (4) with a close space, the corresponding ends of the scraping-wheel shaft (3) are disposed on the same part of the fixed-blade (4), so that the bit structure is more compact or, for the bit of the same size, more cutters can be configured, on the other hand, cutters (41) can be disposed on the fixed-blade (4) in front of, at the back of and between the scraping-wheels (2) to form fixed-blade cutting units in different areas of the fixed-blade. As illustrated in the figures, structure of the embodiment has enlarged the distribution space for the fixed cutters and enables more scraping-wheels to be disposed on the bit, and accordingly, making the bit smaller and more compact, which is favorable for the application of the bit in deep-hole and slim-hole wells drilling. FIG. 28 illustrates the cross-cutting or mesh-like bottomhole pattern scraped by fixed cutters (41) and scraping-wheels with both positive and negative offsets, wherein, the concentric tracks (5) are formed by fixed cutters, and the spiral-like tracks (6) (from the edge to center of the borehole) are formed by scraping-wheels with positive offset while the spiral-like tracks (7) (from center to edge of the borehole) are formed by scraping-wheels with negative offset. Multiple cross-cutting like this is of benefit for cutters effective penetrating in rocks, and consequently, increases the rock-breaking efficiency of the significantly.

Embodiment 4

Figure 10:
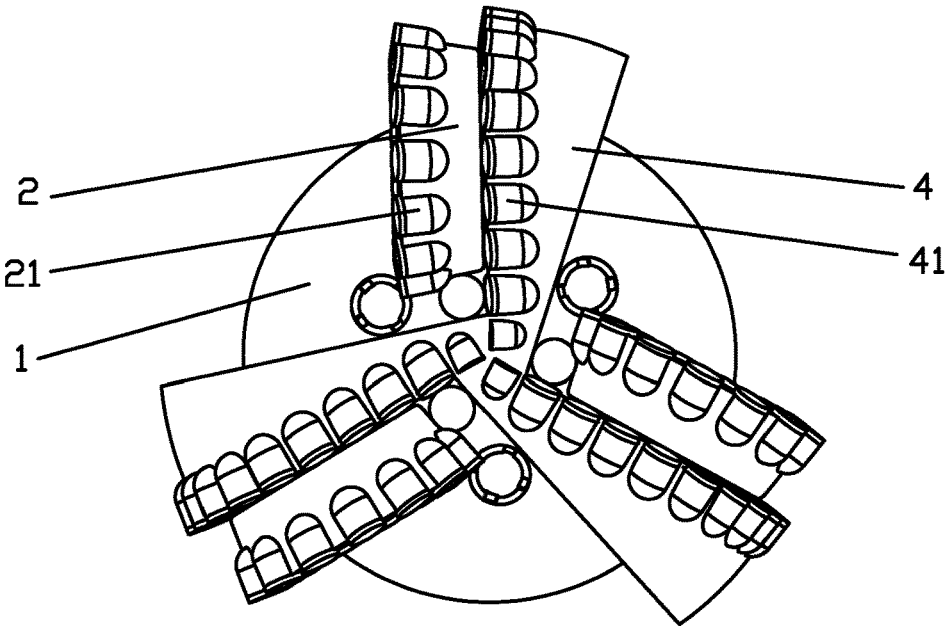
FIG. 10 is a plan view of the bit with the scraping-wheel cutting unit being disposed in front of the fixed-blade.
Figure 11:
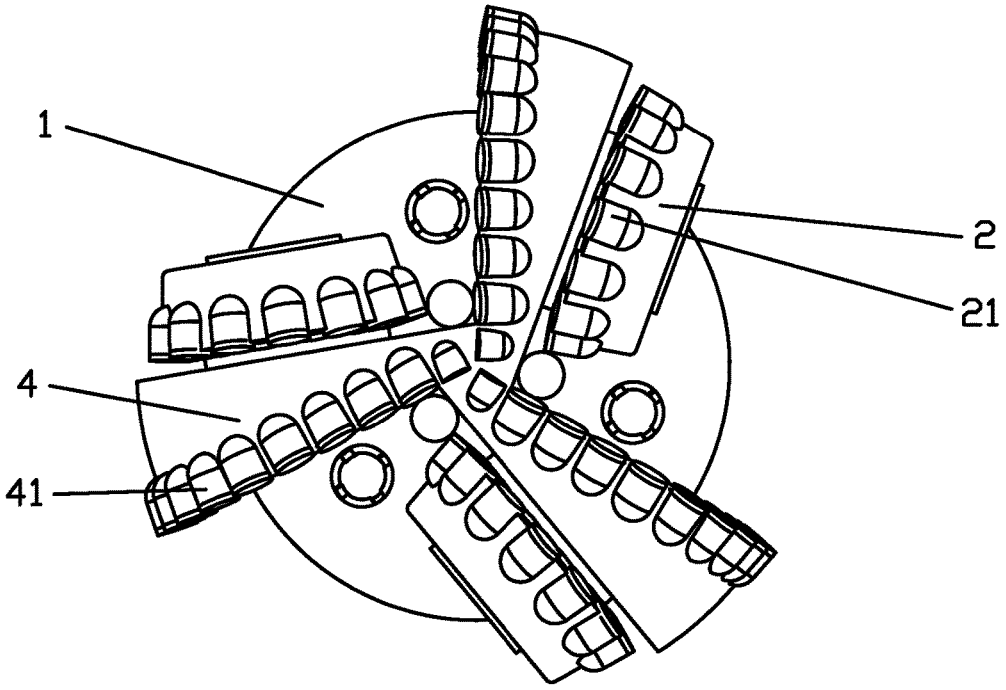
FIG. 11 is a plan view of the bit with the scraping-wheel cutting unit being disposed at the back of the fixed-blade.
Figure 20:
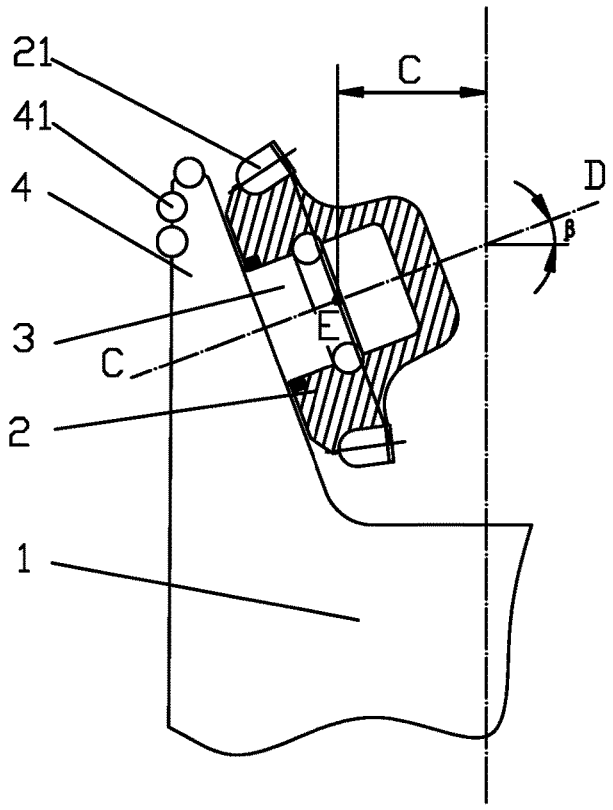
FIG. 20 is a schematic drawing of the bit in the present invention, wherein, the scraping-wheel is disposed on its shaft with rotary connection, while the shaft is formed as an integrated structure with the fixed-blade.
Figure 21:
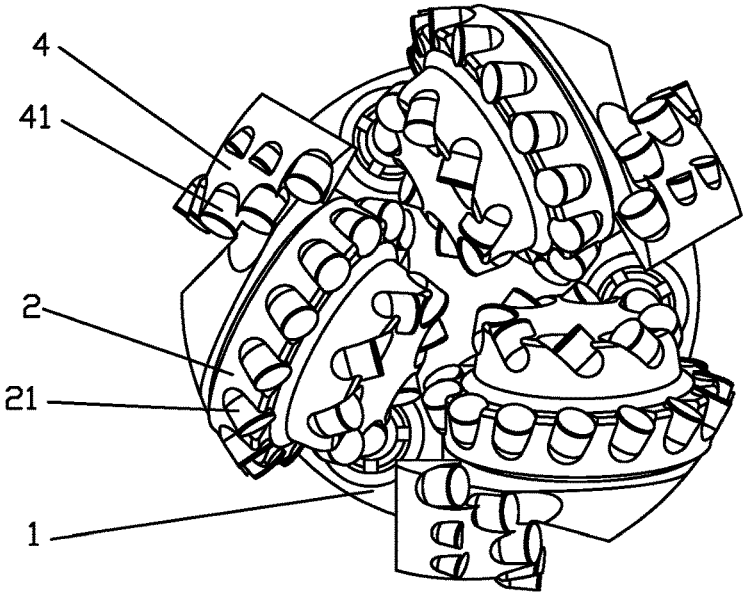
FIG. 21 is a plan view of the bit illustrated in FIG. 20.
Figure 23:
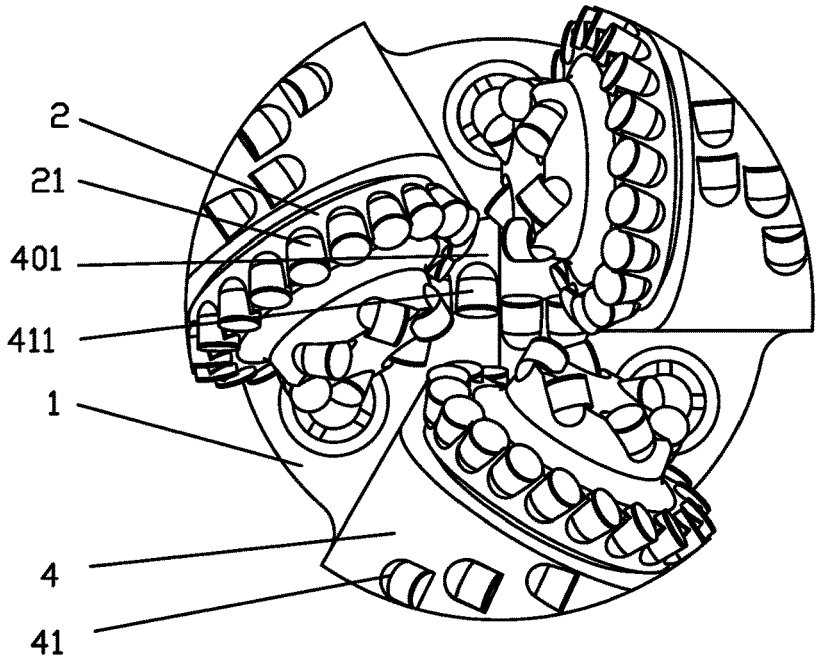
FIG. 23 is a plan view of the bit similar to that in FIG. 21, wherein the difference is that independent fixed-blade cutting units are disposed on central area of the bit.

As illustrated in FIGS. 2, 10, 11, 18, 19, 20, 21, 22 and 23: A composite drill bit with a scraping-wheel cutting unit being disposed on the fixed-blade, comprising: a bit body (1), a fixed-blade (4) and a scraping-wheel (2). The fixed-blade (4) with cutters (41) fixed thereon is configured on the bit body (1). The angular deflection of the scraping-wheel (2) is in the range of $20° \leq |\alpha| \leq 90°$. At least one scraping-wheel cutting unit, which comprises the scraping-wheel shaft (3) and the scraping-wheel (2) with cutters (21) disposed thereon, is configured on the bit body (1). At least one scraping-wheel (2) is disposed on the fixed-blade (4) forming a rotary connection. The scraping-wheel (2) is disposed in front or at the back of the fixed-blade (4), one end of the scraping-wheel shaft (3) is fixed with the scraping-wheel (2) and the other end forms a rotary connection within the fixed-blade (4) (as illustrated in FIG. 20). As illustrated in FIGS. 10 and 21, the scraping-wheel (2) is disposed in front of the fixed-blade (4), in FIG. 11, the scraping-wheel (2) is disposed at the back of the fixed-blade (4), and in FIG. 19, the scraping-wheels (2) are disposed both in front and at the back of the fixed-blade (4). As illustrated in FIG. 23, independent fixed-cutter cutting unit (401) fixed with cutters (411) is disposed on the central area of the bit. Furtherly, this embodiment could be hybridized with Embodiment 2.

Embodiment 5

This embodiment is generally the same as Embodiment 1, 2, 3 or 4, wherein the difference is that at least two scraping-wheel (2) cutting units are disposed on the bit, the angular deflection of at least one scraping-wheel (2) differs from that of the others, as illustrated in FIG. 21, $\alpha 1 \neq \alpha 2$, furtherly, diameters of two scraping-wheels with different angular deflections are not equal.

Embodiment 6

Figure 29:
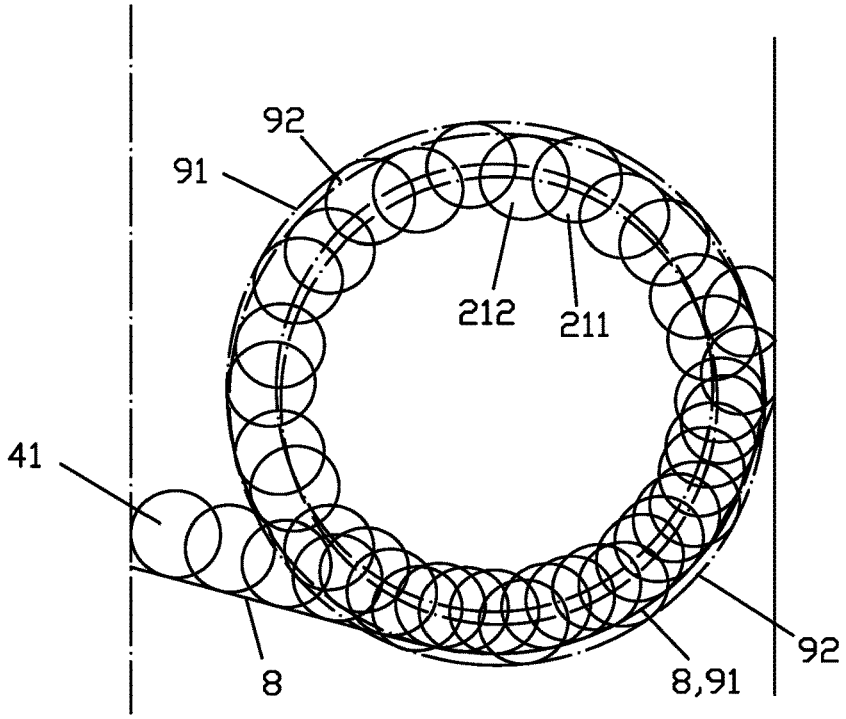
FIG. 29 is a schematic drawing of the cutting profiles of an embodiment in the present invention, wherein, cutting profile of one scraping-wheel cutting unit is higher than that of other cutting units, while profile of the other scraping-wheel being partially matched with the profiles of fixed-blade cutting units.
Figure 30:
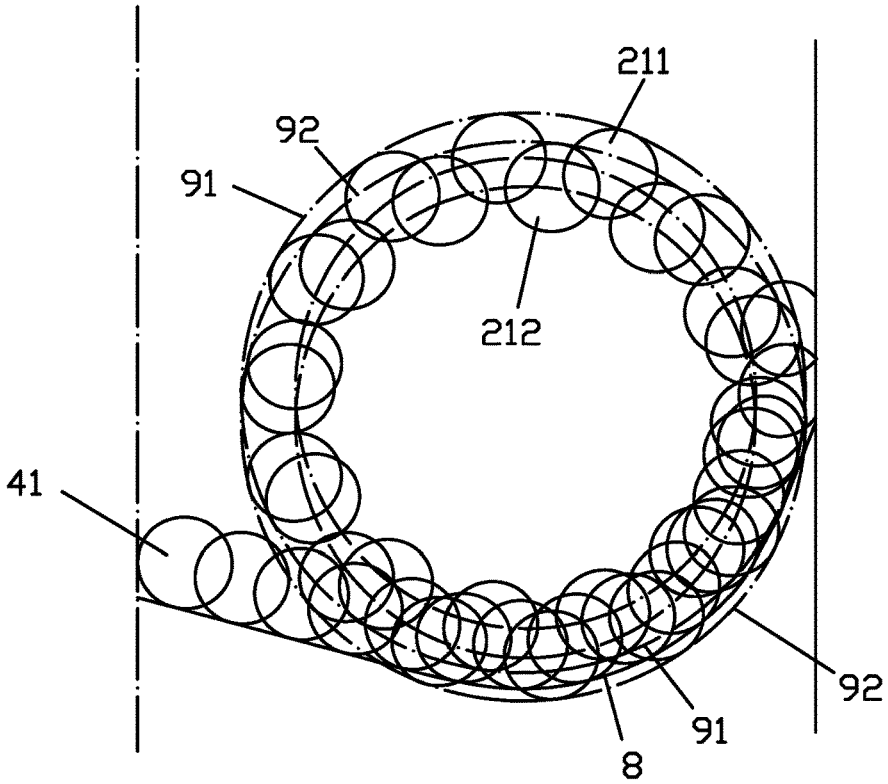
FIG. 30 is a schematic drawing of the cutting profiles of an embodiment in the present invention, wherein, cutting profile of one scraping-wheel cutting unit is higher than that of other cutting units.

This embodiment is generally the same as Embodiment 1, 2, 3 or 4, wherein the difference is that at least two scraping-wheel cutting units are disposed on the bit, the cutting profile of at least one scraping-wheel is lower than the others. As illustrated in FIG. 29, the cutting profile (92) of one scraping-wheel (of which the cutters are labeled 212) is positioned higher than the cutting profile (8) of the fixed-blade and the cutting profile (91) of the other scraping-wheel (of which the cutters are labeled 211), meanwhile, the cutting profile (91) matches with the fixed cutting profile (8). As illustrated in FIG. 30, the cutting profile (91) of one scraping-wheel (of which the cutters are labeled 211) is positioned lower than the cutting profile (8) of the fixed-blade and the cutting profile (92) of the other scraping-wheel (of which the cutters are labeled 212).

Embodiment 7

Figure 31:
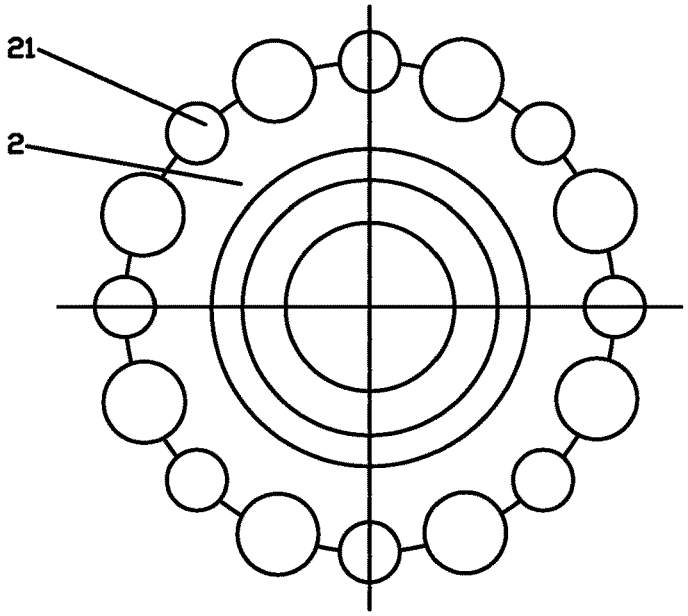
FIG. 31 is a schematic drawing of the scraping-wheel being configured with cutters of different diameters.

This embodiment is generally the same as Embodiment 1, 2, 3 or 4, as illustrated in FIG. 31, wherein the difference is that cutters (21) of different diameters are disposed on at least one scraping-wheel (2).

Embodiment 8

Figure 32:
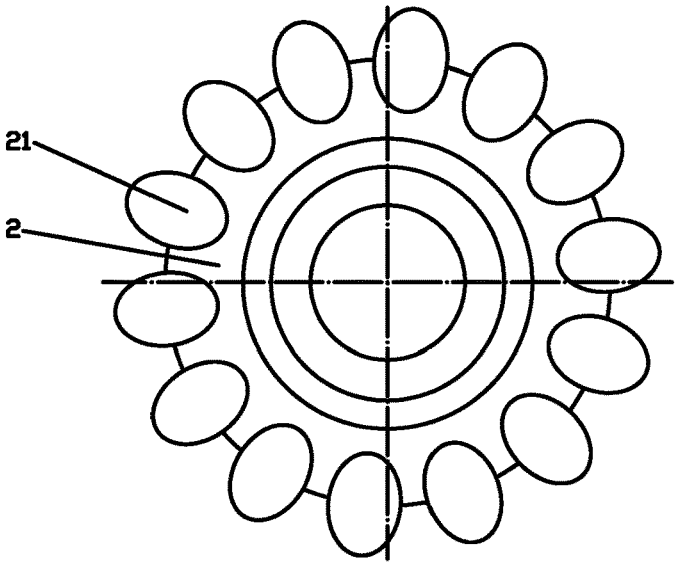
FIG. 32 is a schematic drawing of the scraping-wheel being configured with non-circular section (elliptic section) cutters.
Figure 33:
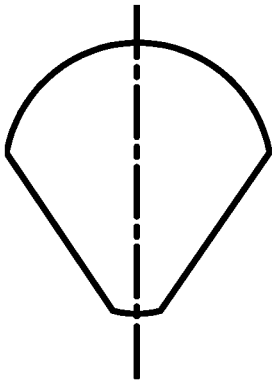
FIG. 33 is a schematic drawing of the wedge-shaped cutter.

This embodiment is generally the same as Embodiment 1, 2, 3 or 4, wherein the difference is that at least one scraping-wheel (2) is disposed with non-circular section cutters (21). FIG. 32 illustrates a scraping-wheel disposed with elliptic section cutters (21), and FIG. 31 illustrates a scraping-wheel disposed with noncircular section cutters (21) with salient point or salient area (such as wedge-shaped cutter).

Embodiment 9

Figure 18:
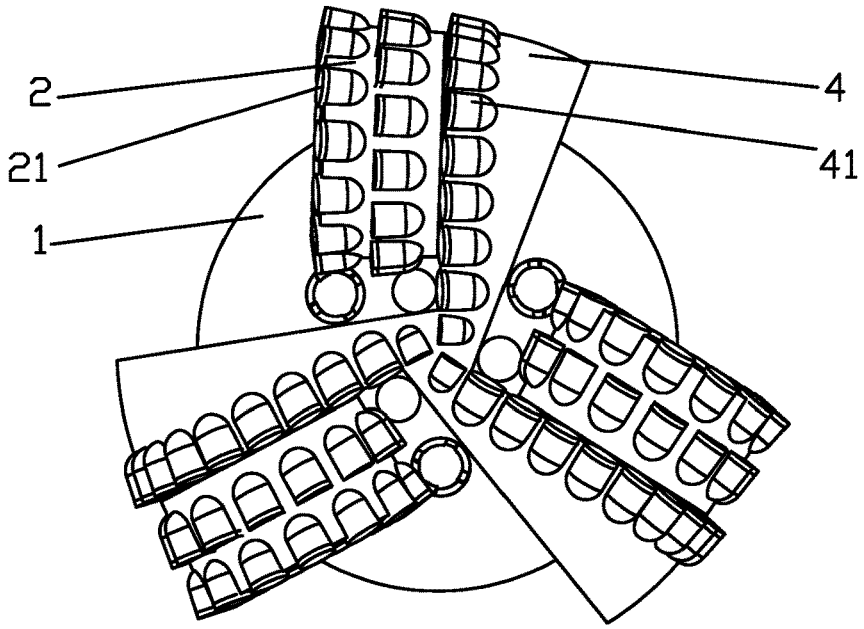
FIG. 18 is a plan view of the bit in present invention, wherein, the scraping-wheel disposed with multiple circles of cutters is located in front of the fixed-blade.
Figure 19:
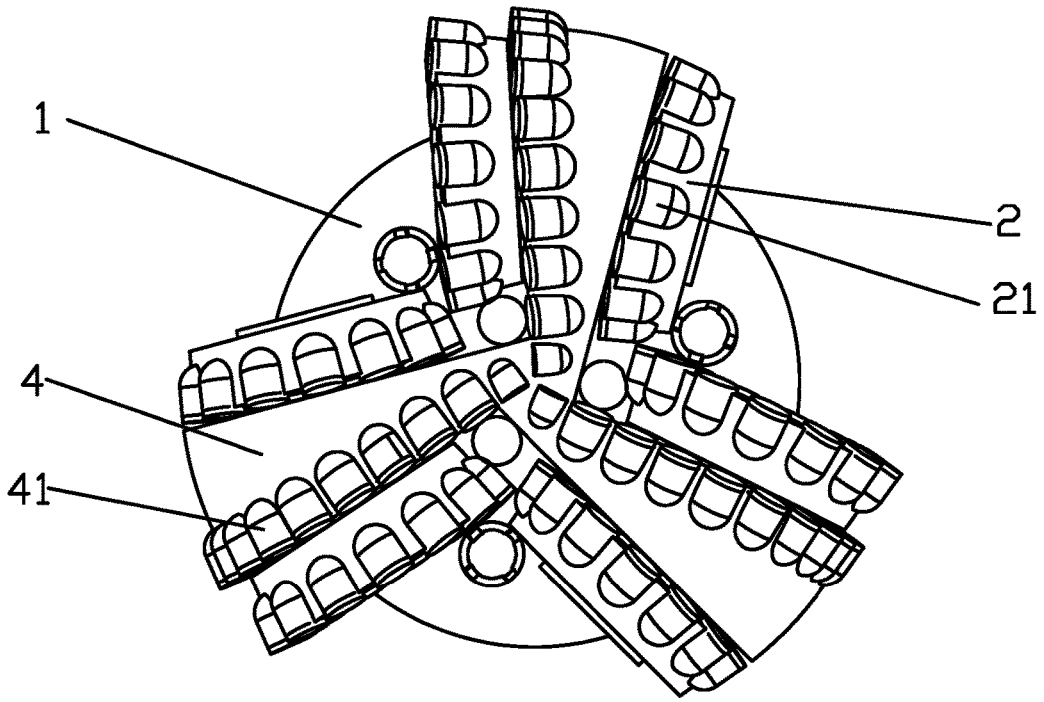
FIG. 19 is a plan view of the bit in present invention, wherein, scraping-wheels are disposed both in front and at the back of the fixed-blade.

This embodiment is generally the same as Embodiment 1, 2, 3 or 4, wherein the difference is that two circles of cutters (21) are disposed on the same scraping-wheel (2), as illustrated in FIGS. 18, 21 and 23, the scraping-wheel (21) is disposed with two circles of cutters (21).

Embodiment 10

This embodiment is generally the same as Embodiment 1, 2, 3 or 4, wherein the difference is that at least two scraping-wheels (2) cutting units are disposed on the bit, the radial position of at least one scraping-wheel (2) on the bit differs from that of the others. Furtherly, diameters of at least two scraping-wheels with different radial positions on the bit are not equal.

The invention claimed is:

1. A composite drill bit, comprising:

a bit body and one or more composite cutting units disposed on the bit body, wherein each composite cutting unit comprises:

a fixed-blade having a fixed-blade body and a plurality of fixed cutters disposed along a circumference of the fixed-blade body; and a scraping-wheel unit having a scraping-wheel rotatably affixed to the fixed-blade body through a shaft connecting the scraping-wheel and the fixed-blade body, wherein the scraping-wheel has a plurality of cutters disposed thereon, wherein the scraping-wheel has an angular deflection in the range of $20° \leq |\alpha| \leq 90°$, wherein the plurality of cutters on the scraping-wheel form a first cutting profile and the plurality of cutters on the fixed-blade form a second cutting profile, wherein the first cutting profile substantially coincides with a portion of the second cutting profile, wherein, in the composite cutting unit, the fixed blade body comprises a first part and a second part separated from each other in a direction of travel about a center longitudinal axis of the composite drill bit by a slot, and further wherein the scraping-wheel unit is disposed in the slot, the shaft of the scraping-wheel unit extends through the scraping-wheel unit, and a first end of the shaft is affixed to the first part of the fixed blade body and a second end of the shaft is affixed to the second part of the fixed blade body.

2. The composite drill bit of claim 1, wherein, in the composite cutting unit, at least one of the plurality of fixed cutters disposed along the circumference of the fixed-blade body are located in the first part of the fixed blade body, the second part of the fixed blade body, or both.

3. The composite drill bit of claim 1, wherein, in the composite cutting unit, the plurality of fixed cutters on the fixed-blade body define a first imaginary surface by setting a boundary of the first imaginary surface and at least a portion the plurality of cutters on the scraping-wheel defines a second imaginary surface by setting a boundary of the second imaginary surface, wherein the second imaginary surface is perpendicular to the scraping-wheel shaft, wherein the first imaginary surface leads or trails the second imaginary surface in a direction of travel about the center longitudinal axis of the composite drill bit.

4. The composite drill bit of claim 3, wherein, in the composite cutting unit, a portion the scraping-wheel is disposed between the first imaginary surface and the second imaginary surface.

5. The composite drill bit of claim 1, wherein the composite cutting unit comprises two of the scraping-wheel units, wherein the fixed blade body has two slots and each slot receives one of the plurality of the scraping-wheel units.

6. The composite drill bit of claim 1, comprising two or more composite cutting units, wherein an angular deflection of the scraping-wheel in at least one of the two or more composite cutting units is different from an angular deflection of the scraping-wheel in at least another of the two or more composite cutting units.

7. The composite drill bit of claim 1, comprising two or more composite cutting units, wherein the scraping-wheel in at least one of the two or more composite cutting units has a positive angular deflection and the scraping-wheel in at least another of the two or more composite cutting units has a negative angular deflection.

8. The composite drill bit of claim 7, wherein the positive angular deflection equals the absolute value of the negative angular deflection.

9. The composite drill bit of claim 1, comprising two or more composite cutting units, wherein the first scraping-wheel in at least one of the two or more composite cutting units has a radial position on the composite drill bit that is different from a radial position of the scraping-wheel in at least another of the two or more composite cutting units.

10. The composite drill bit of claim 9, wherein diameters of the first scraping-wheel and the second scraping-wheel are not equal.

11. The composite drill bit of claim 1, wherein the scraping-wheel has more than one row of cutters.

12. The composite drill bit of claim 1, wherein, in the composite cutting unit, a cutting profile of the scraping-wheel is higher than a cutting profile of the fixed-blade.

13. The composite drill bit of claim 1, comprising two or more composite cutting units, wherein a cutting profile of the scraping-wheel in at least one of the two or more composite cutting units is lower than a cutting profile of the scraping-wheel in at least another of the two or more composite cutting units.

* * * * *